US005575477A

United States Patent [19]

Hwang

[11] Patent Number: 5,575,477

[45] Date of Patent: Nov. 19, 1996

[54] GOLF BALL

[75] Inventor: In H. Hwang, Seoul, Rep. of Korea

[73] Assignee: Ilya Co., Ltd., Seoul, Rep. of Korea

[21] Appl. No.: 359,446

[22] Filed: Dec. 20, 1994

[30] Foreign Application Priority Data

Jan. 25, 1994 [KR] Rep. of Korea ..... 1994-1284

[51] Int. Cl.[6] ..... A63B 37/14

[52] U.S. Cl. ..... 473/379; 473/384

[58] Field of Search ..... 273/232; 40/327; 473/379, 382, 381

[56] References Cited

U.S. PATENT DOCUMENTS 4,560,168 12/1985 Aoyama ..... 273/232

*Primary Examiner*—George J. Marlo
*Attorney, Agent, or Firm*—Dorsey & Whitney LLP

[57] ABSTRACT

A golf ball has a plurality of dimples in its spherical outer surface and its spherical outer surface is divided into the faces of an icosahedron consisting of 20 regular large spherical triangles. Six (6) great circle paths further divide the golf ball's spherical outer surface into the faces of an icosidodecahedron consisting of 20 regular spherical triangles and 12 regular spherical pentagons. The dimple covalent boundary lines are made evenly and uniformly parallel to the regular dividing lines between the regular spherical triangles and the adjacent regular spherical pentagons. The dimple covalent areas are made between the regular spherical triangles and the adjacent regular spherical pentagons. Therefore, the total surface area of dimples are maximized which is a characteristic of the golf ball.

On the polar region, two new larger spherical pentagons are made from the dimple covalent boundary lines which are positioned outside of the regular spherical pentagon along great circle paths on both sides of the polar region. On the equatorial region, ten new smaller spherical pentagons are made from the dimple covalent boundary lines which are positioned inside of the regular spherical pentagons along great circle paths on the equatorial region.

A golf ball having a dimple arrangement in accordance with the present invention maximizes flying distance while maintaining the flying stability by obtaining a balance of the dimple free areas on the polar region and the dimple free areas at the equatorial region (mold parting line).

11 Claims, 9 Drawing Sheets

GOLF BALL

TECHNICAL FIELD

This invention relates to a golf ball. More particularly, the present invention embodies a golf ball having a dimple pattern which maximizes the surface area of the dimples of the golf ball while maintaining a balance between the dimple free polar regions and the dimple free area on the equatorial region, thereby improving the golfball's flight distance while maintaining its aerodynamic stability.

BACKGROUND OF THE INVENTION

A golf ball has numerous dimples on its outer spherical surface. For the most part, dimples are utilized to increase the golf ball's flight distance by decreasing its aerodynamic drag resulting from wind resistance. However, mere increase of dimple surface area tends to decrease the golf ball's associated aerodynamic stability. Therefore, effective dimple configurations not only increase the dimple surface area upon the golf ball's surface but also, account for the associated decrease in stability.

Several inventions exist which relate to methods for increasing the flying distance by optimizing the aerodynamic design of the golf ball's dimple configuration. For example, British Patent No. 377354 discloses a golf ball having an icosahedral dimple arrangement. Other golf ball dimple configurations have been based upon icosahedral or pseudo-icosahedral patterns. However, these configurations have been limited in effectively optimizing the golf ball's carry distance performance, while retaining adequate flight stability characteristics. Prior configurations have increased flight distances by increasing the size or raw numbers of the dimples. However, the golf ball's flight stability characteristics degrade if the dimples are not uniformly disposed so that the dimple-free areas are in balance with one another with respect to the mold parting line of the golf ball cover.

In addition, it has been found that dimples with relatively large diameters and shallow depths tend to increase flight distances. However, such dimples also tend to decrease the flight stability characteristics of the golf ball.

Accordingly, what is desired in the art is an improved golf ball dimple configuration that improves the golf ball's attainable flight distance while retaining good flight stability characteristics.

SUMMARY OF THE INVENTION

This invention relates to a golf ball having a dimple configuration that increases the golf ball's attainable flight distance while retaining good associated flight stability characteristics. In general, this is achieved with an improved icosidodecahedral dimple configuration with various sized dimples that are efficiently distributed throughout the golf ball's surface to reduce the amount of dimple-free area, thereby reducing aerodynamic drag to increase the golfball's attainable flight distance. In addition, the dimple pattern is symmetrical about the equator (mold parting line) towards each pole. Accordingly, a balance is achieved between the dimple-free areas of the polar regions and the dimple-free area of the buffed, equatorial mold parting line region. Also, a dimple depth-to-diameter ratio is utilized that improves flight distances while minimizing flight instability.

This dimple configuration is created by figuratively dividing the surface of the golfball into a spherical icosidodecahedron consisting of twenty regular spherical triangles and twelve regular spherical pentagons. Six great circles, defining the sides of these triangles and pentagons, constitute this geometric configuration. The icosidodecahedron is aligned so that two of its oppositely facing pentagons each contain a pole at their center. These pentagons are denoted "pole pentagons". In turn, one of the six great circles is incident with the spherical surface's equator. Accordingly, the remaining ten pentagons, which adjoin the equator, are "equator pentagons." In addition, the ten regular triangles that adjoin the equator are "equator triangles"; while the remaining ten small triangles adjoining a side of a pole pentagon are "pole triangles."

Dimples of various sizes are uniformly positioned within and with reference to each of these triangles and pentagons. Each dimple corresponds to (is associated with) one of a particular pole pentagon, equator pentagon, pole triangle, or equator triangle. Each side of these pentagons and triangles includes an associated covalent boundary zone. A dimple associated with a given pentagon or triangle may not extend beyond a covalent boundary zone corresponding to that particular pentagon or triangle.

Each covalent boundary zone is uniform in width and defined by one covalent boundary segment that is parallel with and spaced apart from each side of the triangles and pentagons. Each covalent boundary segment will be positioned either interior or exterior to an associated triangle or pentagon; however, each triangle or pentagon side is associated with only one covalent boundary segment. Therefore, each covalent boundary zone, except for those adjoining the equator, is associated with both a pentagon and a triangle or alternatively, with two pentagons, at the side that is common with the two faces.

Covalent boundary segments and thus, the covalent boundary zones, are positioned exterior to each side of the two pole pentagons. Consequently, the most exterior dimples of these pole pentagons may extend beyond their sides to the their corresponding covalent boundary segments. Conversely, covalent boundary segments and thus, associated covalent boundary zones, are positioned within the equator pentagons. Accordingly, the dimples of the equator pentagons may only extend to the sides of these pentagons since they define the exterior boundaries of their covalent boundary zones. With regard to the pole triangles, two of their three covalent boundary segments are common to adjoining equator pentagons and the third segment is common to that of a pole pentagon. Therefore, the two covalent boundary zones adjoining the equator pentagons exist exterior to the pole triangles. On the other hand, the covalent boundary zone that adjoins a side of a pole pentagon is positioned within the pole triangle. Therefore, pole triangle dimples will overlap equator pentagon sides but not those of the pole pentagons. With regard to the equator triangles, two covalent boundary segments are common with those of equator pentagons. Thus, the associated covalent boundary zones occur outside of the equator triangles, within the associated equator pentagons. The remaining covalent boundary segment for each of these equator triangles are positioned adjacent to the equator and interior to the equator triangle. (These particular boundary segments (along with those of the equator pentagons that adjoin the equator) form parallel lines on either side of the equator.) Therefore, equator triangle dimples can overlap the sides adjoining the equator pentagons but may not extend beyond the sides adjoining the equator.

With these principles in mind, dimples are uniformly positioned within each of the triangles and pentagons such that the dimple configurations for the pole pentagons are substantially equivalent, the dimple configurations for the equator pentagons are substantially equivalent, the dimple configurations for the pole triangles are substantially equivalent, and the dimple configurations for the equator triangles are substantially equivalent. The area (mold parting line region) between the two boundary lines that are parallel with and on either side of the equator is buffed to create a dimple-free region.

In accordance with this configuration, the total dimple surface area is maximized while flight stability is maintained by balancing the dimple-free areas of the polar regions and the dimple-free areas of the equatorial region.

BRIEF DESCRIPTION OF THE DRAWINGS

The invention will be explained in conjunction with an illustrative embodiment shown in the accompanying drawing, in which

FIG. 19 also illustrates the buffed mold parting line region, which is the dimple free area between the two boundary lines parallel to the equator.

DETAILED DESCRIPTION OF THE PREFERRED EMBODIMENT

Figure 1:
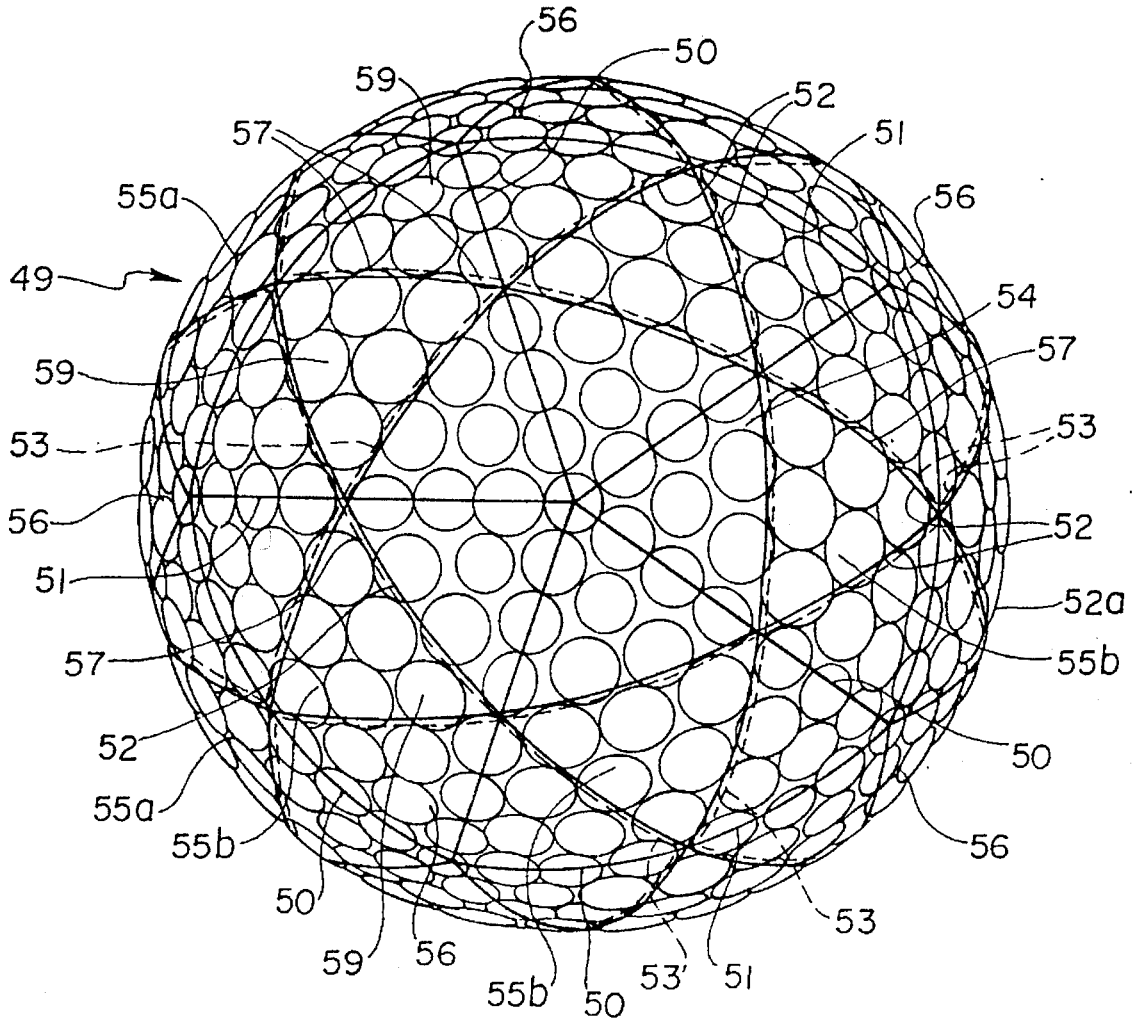
FIG. 1 is a polar view of a golf ball constructed in accordance with the invention and illustrates the dimple covalent boundary segments and the dimple arrangement, and also illustrates a dimple pattern by a uniform distribution of dimples on the surface of the golf ball in accordance with the present invention.
Figure 2:
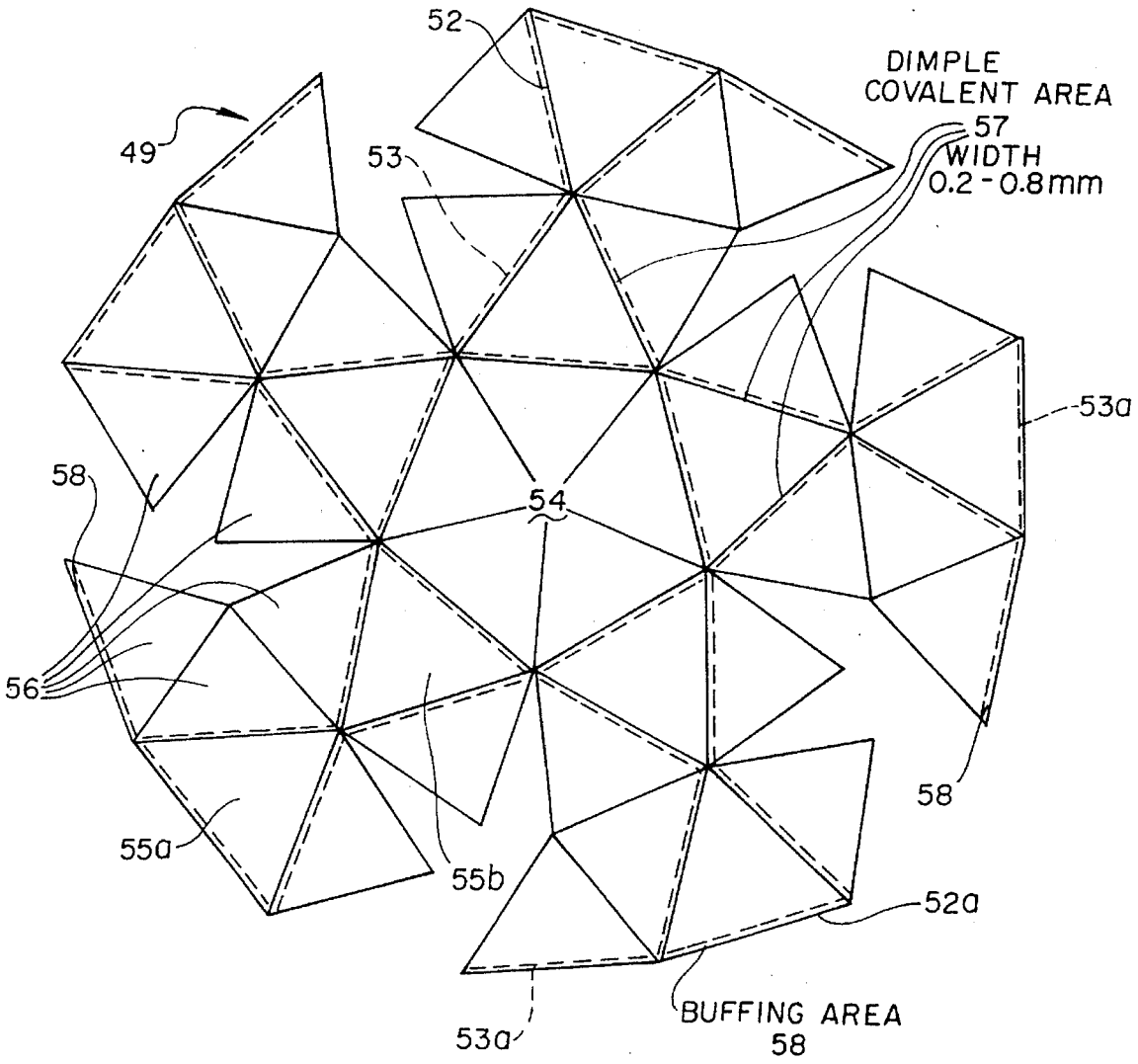
FIG. 2 illustrates the geometric partition of half of the spherical outer surface which has a composition of an icosahedron (thick solid lines) and an icosidodecahedron (thin solid lines). A new composition of the half spherical outer surface by the dimple covalent boundary segments (thin dotted lines) in accordance with the invention is illustrated.

The present invention relates to a golf ball having a dimple configuration associated with its outer spherical surface that improves the golf ball's attainable carry distance while maintaining flight stability. In particular, the present invention incorporates a dimple configuration with dimples of various sizes that are uniformly distributed symmetrically about the equator towards each of the two poles.

With reference to FIGS. 1, 3, 4, and 8, the surface of a golf ball 49 is divided by thick solid lines 50 into an icosahedron consisting of twenty regular large spherical triangles 51. (These lines, along with other lines referred to in this specification, do not necessarily appear on the golf ball's surface but rather, are imaginary lines used to define the relative positioning of the various dimples.) If the adjacent midpoints of the sides of each of these twenty large spherical triangles are connected to one another with thin solid lines 52, an icosidodecahedron consisting of twenty regular spherical triangles 55*a*, 55*b* and twelve regular spherical pentagons 54, 56, is formed. The thin solid lines 52 also constitute six great circles that in turn, can be used to define the icosidodecahedron. One of these six great circles is the equator 52*a*.

Dimple covalent boundary segments 53 (shown by the thin dotted lines) are utilized to define relative boundaries for dimples that overlap the sides of the twenty regular triangles 55*a*, 55*b* and twelve regular pentagons 54 and 56. These covalent boundary segments 53 are uniformly spaced apart from and aligned parallel with the six great circles 52 (which define the twenty regular triangles 55*a*, 55*b* and twelve regular pentagons 54 and 56) by a fixed distance. The value of this fixed distance should be between 0.2 mm and 0.8 mm. (Note that each side of a pentagon or triangle is associated with only one covalent boundary segment. Therefore, each covalent boundary zone, except for those adjoining the equator, is associated with both a triangle and a pentagon or with two pentagons, at their common, adjoining side.)

The covalent boundary segments 53 define geometric shapes (of equal or unequal size) that correspond to each of the regular triangles 55*a*, 55*b* and regular pentagons 54 and 56. With the two regular "pole pentagons" (pentagons having a pole at their centers), covalent segments define a pentagon that is aligned with and larger than its associated pole pentagon. With the ten "equator pentagons" (regular pentagons 56 that adjoin the equator 52*a*), the covalent segments 53 define a pentagon that is smaller than and aligned with each of the equator pentagons. With the ten regular "equator triangles" (regular triangles 55*a* that adjoin the equator 152*a*), the covalent segments 53 define triangles of equal size that are shifted toward their associated hemispherical pole. Finally, with the regular "pole triangles" 55*b* (the regular triangles that adjoin a pole pentagon 54), the covalent boundary segments define regular triangles of equal size that are shifted toward the equator 52*a*.

Dimple covalent zones 57 are defined by the areas between the dimple covalent boundary segments 53 and the six great circles 52 (which define the regular triangles 55*a*, 55*b* and regular pentagons 54, 56.) With one embodiment of this invention, a dimple configuration is based upon placing the dimples within and aligning the dimples with respect to each of the twenty regular triangles 55*a*, 55*b* and twelve regular pentagons 54, 56. In positioning dimples within each of these triangles or pentagons, dimples are not to extend beyond the covalent boundary zone 57 that are associated with the particular regular triangle or regular pentagon.

Figure 3:
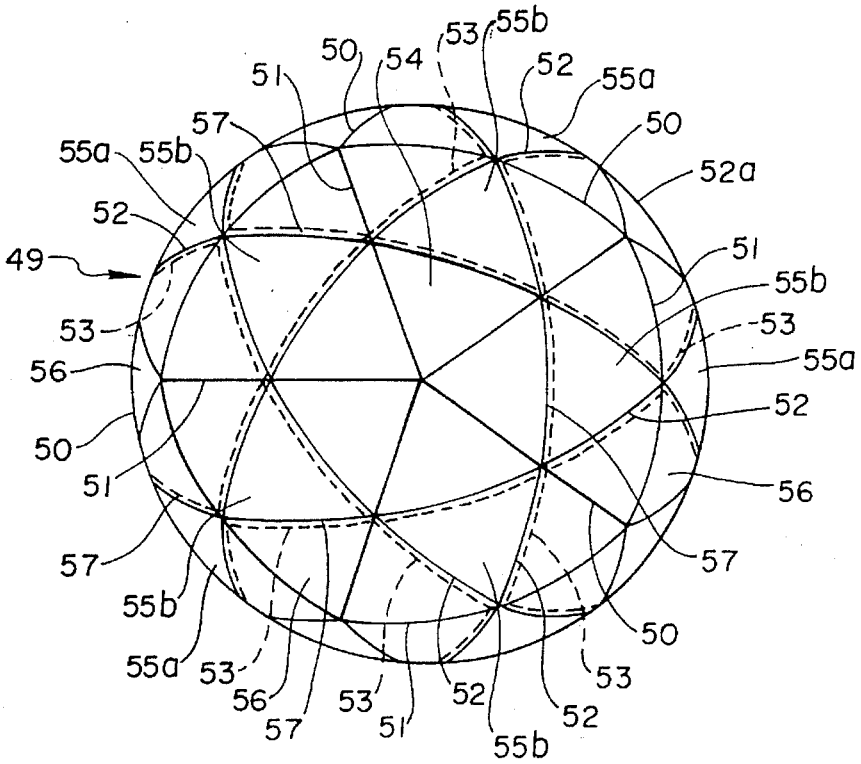
FIG. 3 is a polar view of a surface of a sphere constructed in accordance with the new composition of the invention, which illustrates the location and the relation between the icosahedron composition (thick solid lines), icosidodecahedron composition (thin solid lines), and the dimple covalent boundary segments (thin dotted lines).
Figure 9:
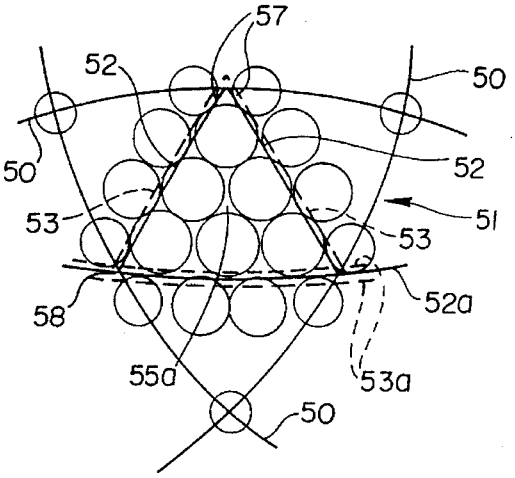
FIG. 9 is one of the regular large spherical triangles positioned on the equatorial region of an icosahedron of FIG. 8, which illustrates a simplification of the dimple arrangement on an icosidodecahedral equator triangle.
Figure 10:
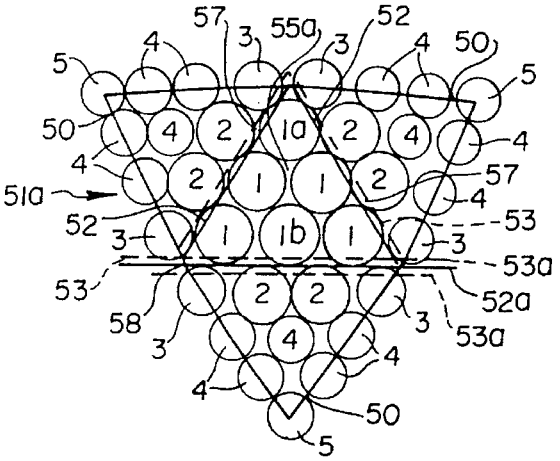
FIG. 10 is a geometric illustration of the state of the dimple pattern according to the kind of dimples in the large spherical triangle on the equatorial region of a sphere having an icosahedron composition, focusing on the icosidodecahedral equator triangle, which is the same as FIG. 9.

With reference to FIG. 3, dimple covalent boundary segments 53 that correspond to each of the two pole pentagons 54 ( as well as to one side of the small regular pole triangles 55*b*) are located outside of each of the two regular pole pentagons 54. (These boundary segments formulate a larger pentagon that extends beyond and is aligned with each of the two pole pentagons 54.) Therefore, the most exterior polar dimples (corresponding to the pole pentagons 54) overlap the sides of the two regular pole pentagon 54 touching the extended covalent boundary lines 53 (see dimples 2*a* in FIG. 7 and dimples 9*a* in FIG. 15). This means that these most exterior polar dimples exist partially within the interiors of the small regular triangles 55*b* that adjoin the pole pentagons 54. The amount by which the dimples extend beyond the regular pole pentagon dividing lines 52 to touch the dimple covalent segments 53 depends on the selected width of the dimple covalent zone 57. Dimples (3*a* in FIG. 7 and 9*b* in FIG. 15) positioned within the five vertices of each of the two pole pentagons 54 may be circular or elliptical in shape. In addition, these vertice dimples 3*a* and 9*b* preferably do not extend beyond the sides of the pole pentagons 54 into covalent boundary zones 57. This constraint serves to change the flow of air, thereby functioning to set an axis of revolution. The remaining dimples of the two regular pole pentagons 54 may be uniformly distributed within the pole pentagons as shown, for example, in FIGS. 1, 7, and 15. However, the dimple configurations for each of the two regular pole pentagons should be substantially identical to one another.

Figure 4:
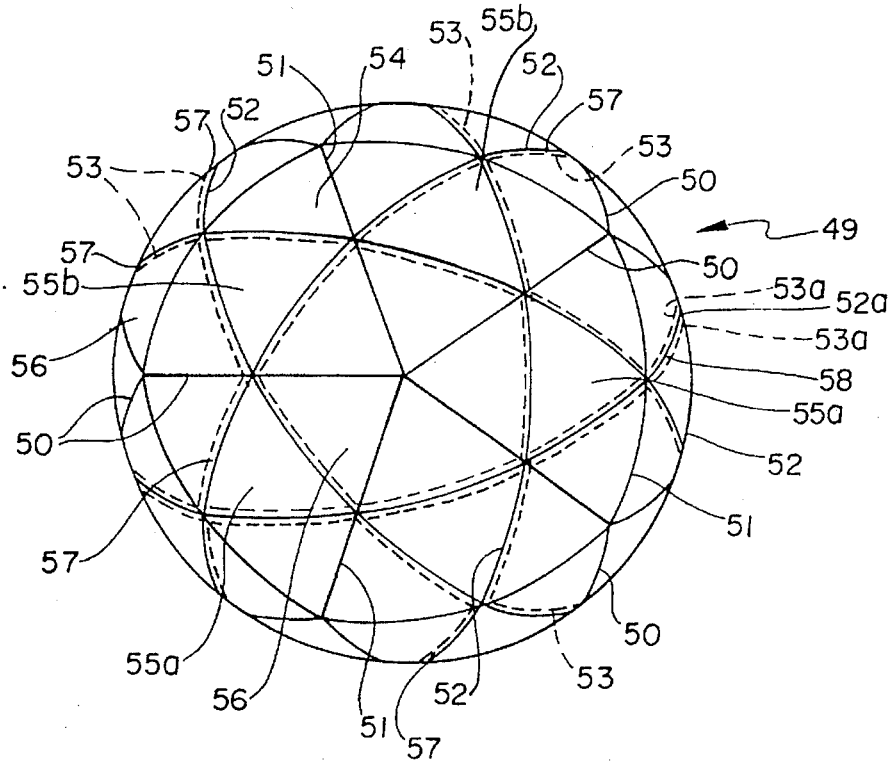
FIG. 4 is an equatorial view of a surface of a sphere constructed in accordance with the new composition of the invention, which illustrates a location and a relation between the icosahedron composition (thick solid lines), the icosidodecahedron composition (thin solid lines), and the dimple covalent boundary segments (thin dotted lines).
Figure 5:
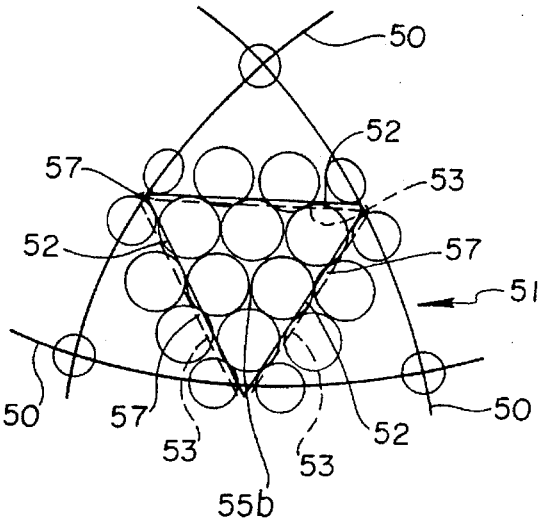
FIG. 5 is one of the regular large spherical triangles positioned on the polar region of the spherical outer surface in the icosahedron composition of FIG. 1, which illustrates a simplification of the dimple arrangement on the central spherical triangle which is one of the regular triangles formed by connecting the midpoints of the sides of the large spherical icosahedral triangle.
Figure 11:
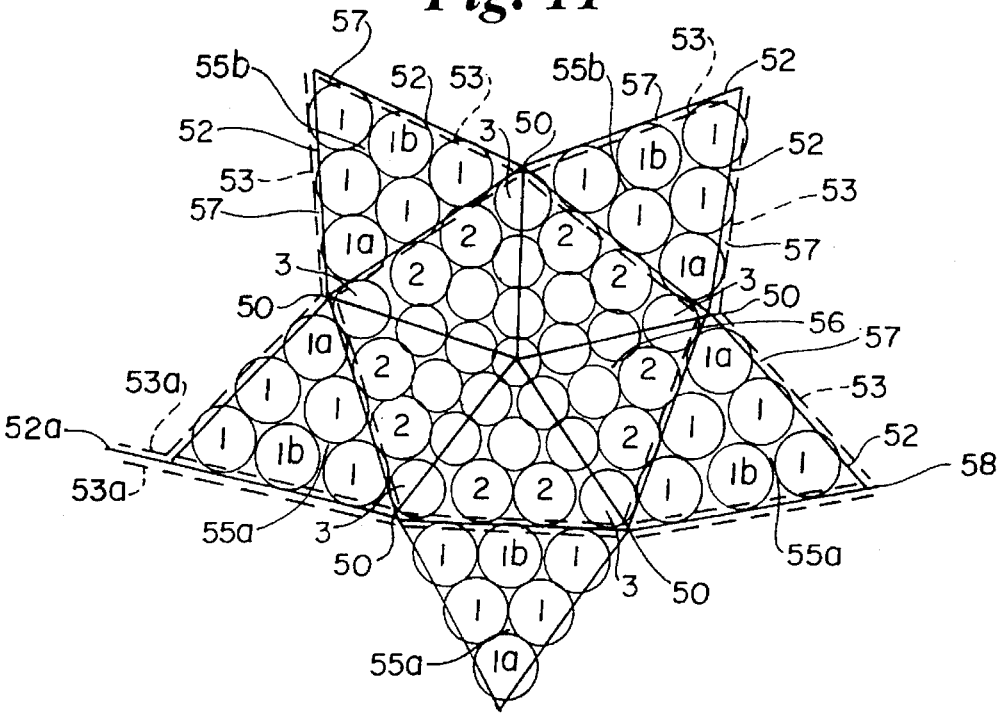
FIG. 11 is a geometric illustration of the surface of the golf ball of FIG. 8 having an icosidodecahedron composition and showing the position of the dimple covalent boundary segments and the dimple arrangement of an equator pentagon with adjoining pole and equator triangles.
Figure 12:
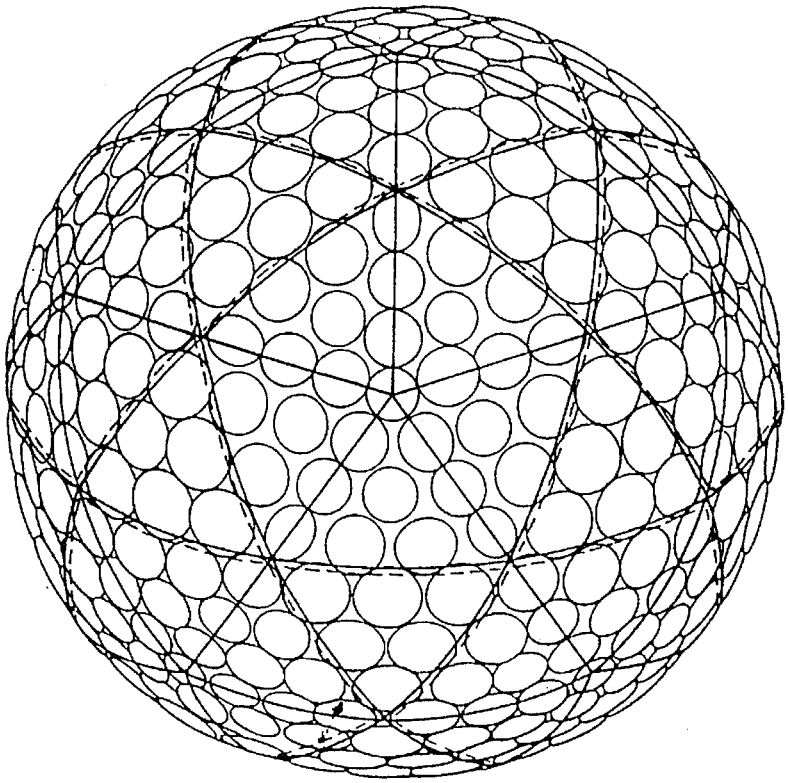
FIG. 12 is a polar view of a surface of the golf ball constructed in accordance with the invention, which illustrates the dimple covalent boundary segments and a different dimple pattern arrangement formed by different sized dimples in comparison with FIG. 1.
Figure 13:
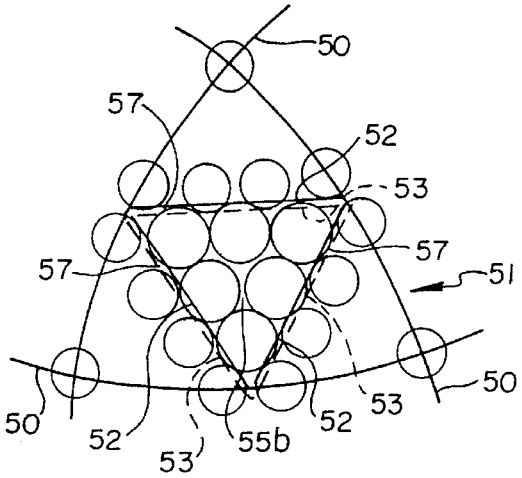
FIG. 13 is one of the regular large spherical triangles positioned on the polar region of the outer spherical surface having an icosahedron composition of FIG. 12, and illustrates a simplification of the dimple arrangement on a pole triangle.
Figure 14:
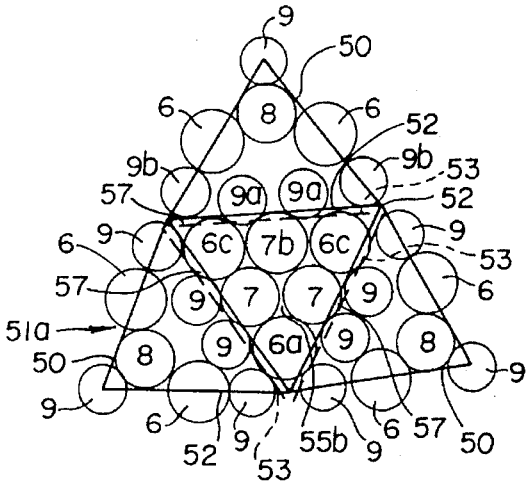
FIG. 14 is a geometric illustration of the state of dimple pattern according to the kind of dimples in the large spherical triangle on the polar region of the outer spherical surface having an icosahedron composition, focusing on a pole triangle, which is the same as FIG. 13.
Figure 19:
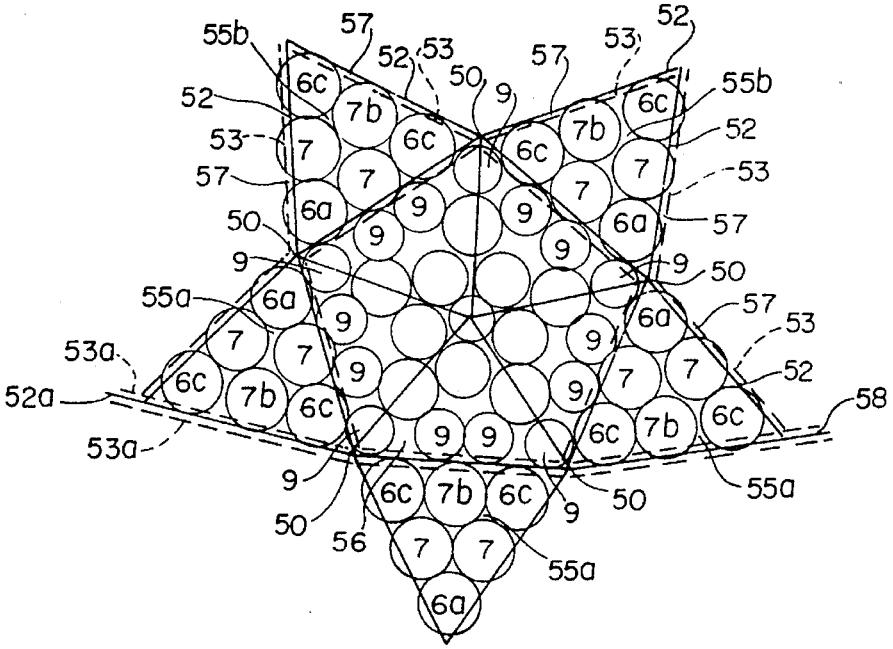
FIG. 19 is a geometric illustration of the surface of the golf ball of FIG. 16 having an icosidodecahedron composition and showing the position of the dimple covalent boundary segments and a dimple arrangement, based on the invention, at an equator pentagon with adjoining pole and equator triangles.
Figure 20:
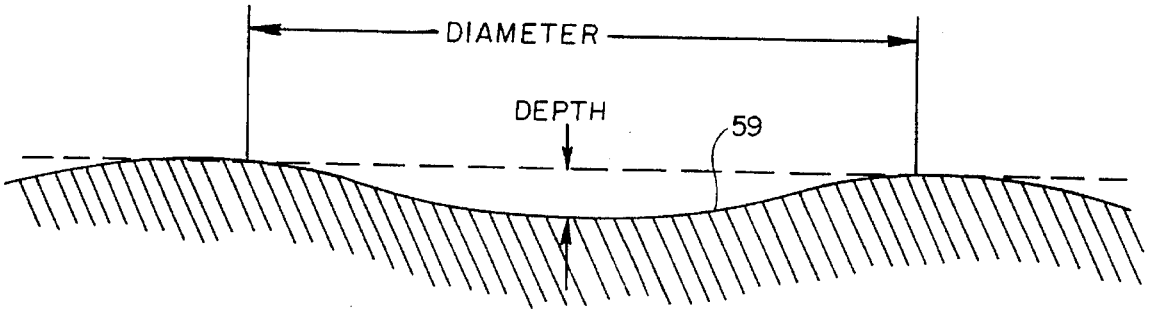
FIG. 20 illustrates the method of determining diameter of a dimple and the depth of a dimple.

With reference to FIG. 4, covalent boundary segments 53 that correspond to the ten regular equator pentagons 56 (as well as to two of the sides of each of the twenty small regular triangles 55*a*, 55*b*) are uniformly positioned within their associated equator pentagons 56 to form smaller pentagons that are each aligned within an associated equator pentagon 56. Thus, the corresponding dimple covalent zones 57 exist inside of these equator pentagons 56. Consequently, the most exterior dimples (2 in FIG. 11 and 9 in FIG. 19) of these regular spherical equator pentagons extend to and not beyond the dividing lines (or sides) 52 of the equator pentagons. The remaining dimples of the equator pentagons 56 are uniformly positioned (as shown, for example, in FIGS. 11 and 19) within each of equator pentagons 56. Note that the dimple configuration for each of the ten regular equator pentagons should be substantially equivalent with one another.

Figure 6:
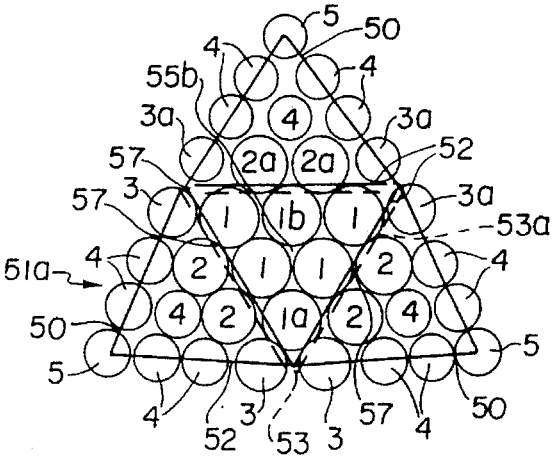
FIG. 6 is a geometric illustration of a dimple pattern according to the dimples in the large spherical triangle on the polar region of the spherical outer surface in the icosahedron composition, focusing on the regular icosidodecahedral spherical triangle, which is the same as FIG. 5.
Figure 7:
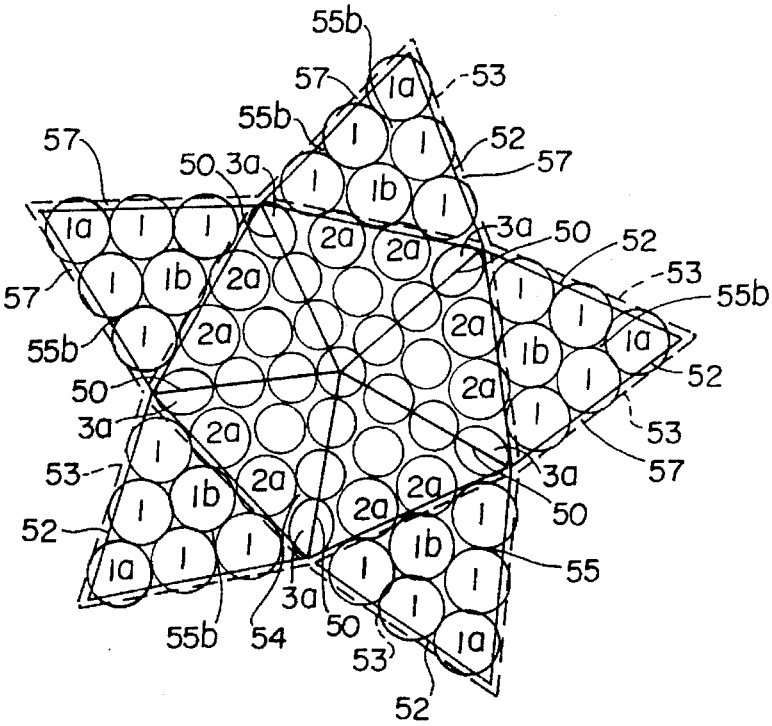
FIG. 7 is a geometric illustration of the surface of the golf ball of FIG. 1 having an icosidodecahedron composition and showing the position of dimple covalent boundary segments and a dimple arrangement, based on an embodiment of the invention, at the pole pentagon and pole triangles.
Figure 8:
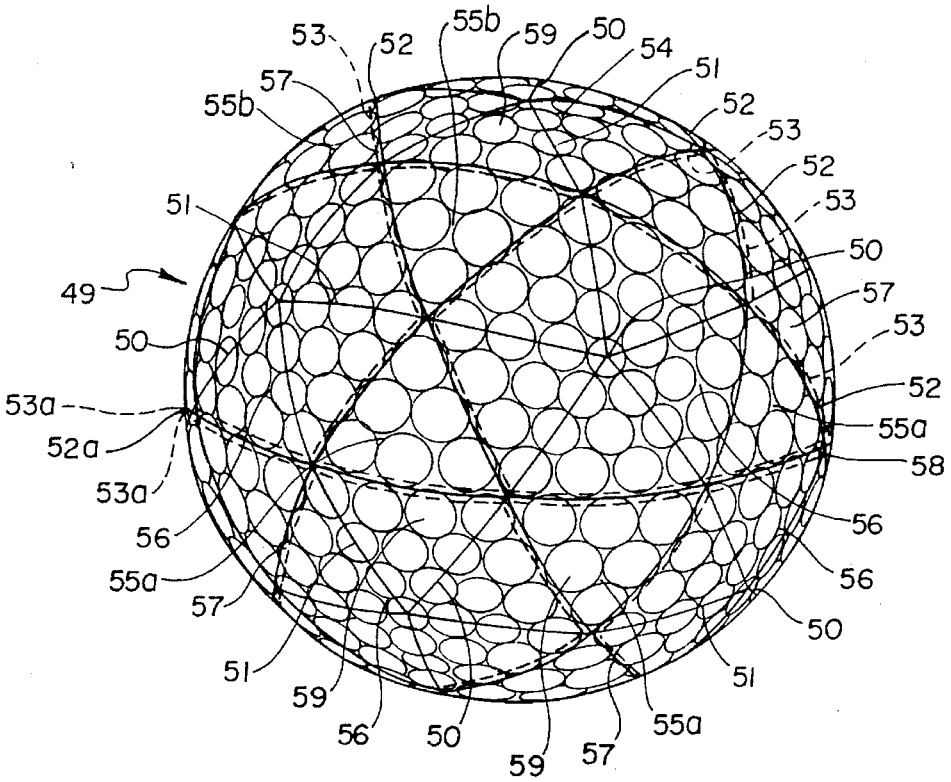
FIG. 8 is an equatorial view of the surface of a golf ball in accordance with the present invention.
Figure 15:
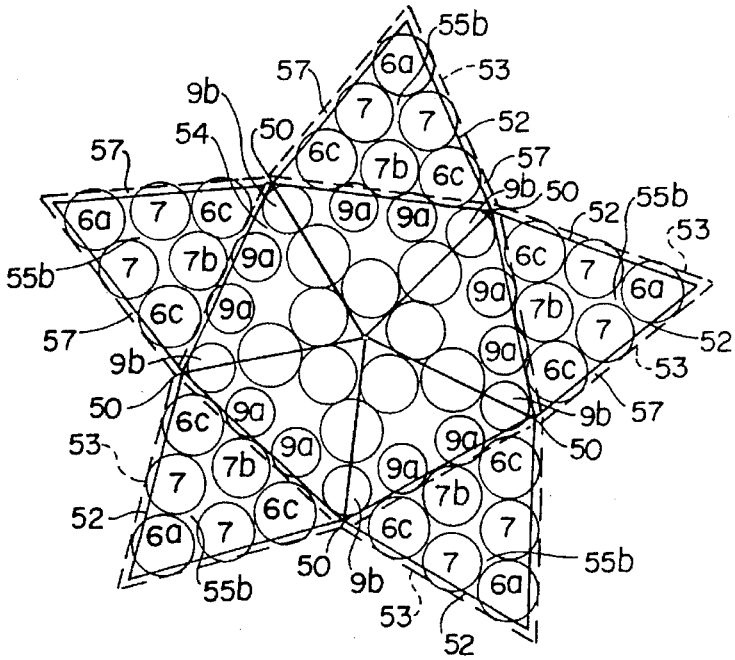
FIG. 15 is a geometric illustration of the surface of the golf ball of FIG. 12 having an icosidodecahedron composition and showing the position of dimple covalent boundary lines and the state of dimple arrangement, based on the invention, at a pole pentagon with adjoining pole triangles.
Figure 16:
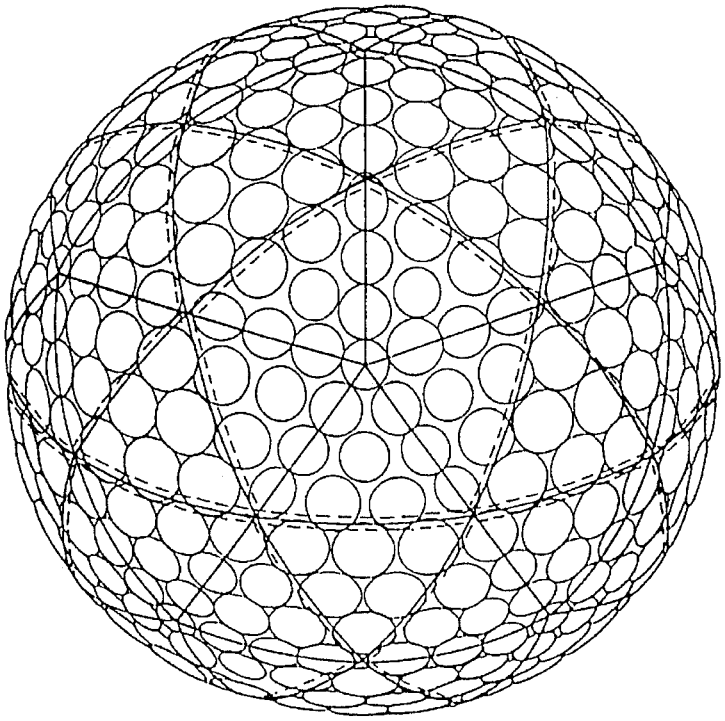
FIG. 16 is an equatorial view of the surface of the golf ball of FIG. 12, illustrating the whole distribution of dimples, the formation of the dimple covalent boundary segments, and an interval which can be turned into a dimple free area between the two boundary lines parallel to the equator.
Figure 17:
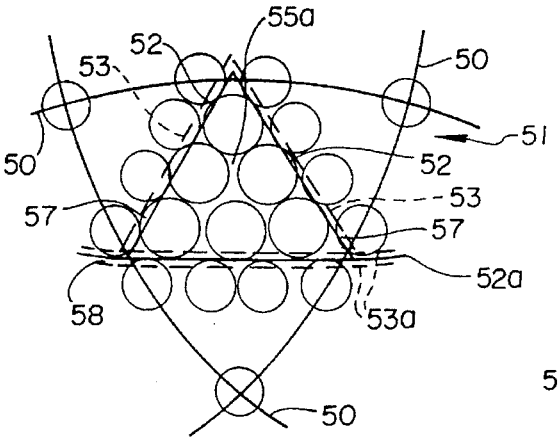
FIG. 17 is one of the regular large spherical triangles positioned on the equatorial region of an icosahedron of FIG. 16, illustrating a simplification of the dimple arrangement on an equator triangle.
Figure 18:
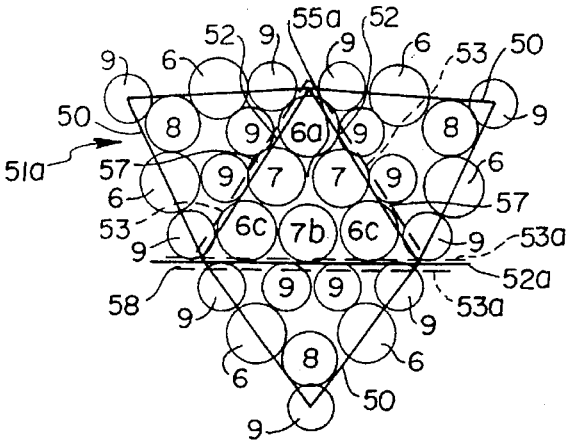
FIG. 18 is a geometric illustration of the state of dimple pattern according to the kind of dimples in the large spherical triangle on the equatorial region of the outer spherical surface having an icosahedron composition, focusing on an equator triangle.

As depicted in FIG. 3, the covalent boundary segments for the regular pole triangles 55*b* are common to and thus, formed by boundary segments 53 from the pole pentagons 54 and equator pentagons 56. These common boundary segments define triangles that are equivalent in size and shape with these regular pole triangles 55*b*. However, these covalent boundary segment triangles are shifted downward from their associated pole triangle 55*b*. Therefore, the covalent boundary zones 57 that are associated with these pole triangles 55*b* are located within the pole triangles on the sides that adjoin the pole pentagons 54 and located externally to the pole triangles on the sides that adjoin equator pentagons 56. Therefore, covalent boundary zones 57 located adjacent to the pole pentagons 54 exist within the pole triangles 55*b*. In turn, the covalent boundary zones 57 adjacent to the equator pentagons 56 are contained within the corresponding equator pentagons. Consequently, the most exterior dimples (such as 1, 1*b* in FIG. 7 and 6*c*, 7*b* in FIG. 15) adjoining pole pentagons may touch but not extend beyond the sides 52 that adjoin the pole pentagons 54. Conversely, the most exterior dimples (for example, 1, 1*a* in FIG. 7 and 6*a*, 6*c*, 7 in FIG. 15) adjacent to the equator pentagons 56 extend beyond the pole triangle sides 52 to the edges of the boundary segments 53 within the equator pentagons 56. The remaining dimples may be uniformly distributed within the regular pole triangles 55*b*, as shown, for example, in FIGS. 7, 8, 9, 11 and 15. These patterns, as depicted in FIGS. 7 and 15, eliminates a variation in air flow by the partition with this composition. As a result, the dimples function to decrease air resistance. Thus, the present invention eliminates a disadvantage due to a partition while maximizing the overall surface of the dimples, thereby increasing the carry distance. Note that the dimple configuration for each of the ten regular pole triangles 55*b* should be substantially equivalent with one another.

With reference to FIG. 4, each of the ten regular equator triangles have covalent boundary segments 53 (adjacent to their equator pentagon sides 52) that are located outside of the equator triangles 55*a* and an equator covalent boundary segment 53*a* that is adjacent and parallel with the equator 52*a* and located within the equator triangle. The boundary segments 53 form triangles that are equivalent in size and shape to the equator triangles 55*a* but shifted toward their respective poles, away from the equator 52*a*. Therefore, the associated covalent boundary zones 57 that are adjacent to the equator pentagons 56 are located within these pentagons. Alternatively, the covalent boundary zones 57 adjacent to the equator 52*a* exist within the equator triangles 55*a*. Consequently, exterior dimples adjacent to the equator pentagons 56 (for example, 1, 1*a* in FIG. 11 and 6*a*, 6*c*, 7 in FIG. 19) cross over the sides 52 of the equator triangles 55*a*, touching the covalent boundary lines 53 within the equator pentagons 56. The dimples adjoining the equator 52*a* such as 1, 1*b*, existing within the covalent boundary zone 57 extend beyond the equator boundary segments 53*a* and touch the equator 52*a*. The area between the opposing equator boundary segments 53*a* (which are parallel to the equator) is buffed to create a buffed mold parting line region 58. The remaining dimples may be uniformly positioned within the equator triangles 55*a*, as shown, for example, in FIGS. 8, 11, and 19. Note that the dimple configuration for each of the ten regular equator triangles should be substantially equivalent with one another.

The depth of a dimple, for a given dimple size, should be a value that falls between 3.5% and 5.5% of the given dimple's diameter. This depth to diameter ratio makes the smaller dimples relatively shallow and the larger dimples relatively deep. This enhances the golf ball's flying stability.

While the preferred embodiment of the present invention has been described, it should be appreciated that various modifications may be made by those skilled in the art without departing from the spirit and scope of the present invention. For example, as shown in FIGS. 6, 10, 14, and 18, embodiments of the present invention utilize a dimple configuration where the smallest sized dimples 5, 6, and 9 are located on the vertices of the regular large spherical triangles 51 of the initial icosahedron. Accordingly, reference should be made to the claims to determine the scope of the present invention.

What is claimed is:

1. A golf ball having an outer spherical surface, which includes two associated poles and an equator, the outer spherical surface being figuratively divided into a spherical icosidodecahedron having 2 regular pole pentagons, 10 regular equator pentagons, 10 regular pole triangles and 10 regular equator triangles that are each defined by imaginary sides constituting six great circles, one of the great circles being the equator, the golf ball comprising:

a plurality of imaginary covalent boundary zones, each zone being the area between a side of a pole pentagon, equator pentagon, pole triangle or equator triangle and the side's one associated covalent boundary segment, which is parallel to and spaced apart from the given side; and a plurality of dimples including a set of most exterior dimples for each of the pole pentagons, equator pentagons, pole triangles, and equator triangle, a major portion of each one of the plurality of dimples being positioned within an associated one of the pole pentagons, equator pentagons, pole triangles, or equator triangles, wherein at least a portion of each set of most exterior dimples partially exists within but not beyond the covalent boundary zones of their associated pole pentagon, equator pentagon, pole triangle, or equator triangle, whereby some of the at least a portion of each set of most exterior dimples are intersected by a great circle.

2. The golf ball of claim 1, wherein the covalent boundary zones associated with the pole pentagons are outside of the pole pentagons and the covalent boundary zones associated with the equator pentagons are inside of the equator pentagons.

3. The golf ball of claim 2, wherein the widths of the covalent boundary zones associated with the pole and equator pentagons are substantially equivalent to one another with a value that is between 0.2 and 0.8 mm.

4. The golf ball of claim 3, wherein the covalent boundary zones associated with the pole triangles and adjacent to equator pentagons are within the equator pentagons and the covalent boundary zones associated with the equator triangles and adjacent to equator pentagons are within the equator pentagons.

5. The golf ball of claim 4, wherein the widths of the covalent boundary zones associated with pole and equator triangles are substantially equivalent to one another with a value that is between 0.2 and 0.8 mm.

6. The golf ball of claim 5 wherein covalent boundary zones associated with the regular equator triangles and adjacent to the equator are located within the regular equator triangles, with their widths being substantially equivalent to one another and having a value that is between 0.2 and 0.8 mm.

7. The golf ball of claim 6 further comprising a buffed mold parting line region.

8. The golf ball of claim 7 further comprising dimples having at least 3 different diameters.

9. The golf ball of claim 8 wherein the values of the various dimple diameters fall within the range of 2.92 mm to 3.94 mm.

10. The golf ball of claim 9 wherein the depth of each dimple is between 3.5% and 5.5% of the diameter of the dimple.

11. The golf ball of claim 1, wherein the plurality of dimples include dimples of various sizes.

* * * * *